US006516762B2

(12) United States Patent
Kinugawa et al.

(10) Patent No.: US 6,516,762 B2
(45) Date of Patent: Feb. 11, 2003

(54) VALVE TIMING ADJUSTING DEVICE HAVING SEAL UNIT

(76) Inventors: Hiroyuki Kinugawa, c/o Mitsubishi Denki Kabushiki Kaisha 2-3, Marunouchi 2-chome, Chiyoda-ku, Tokyo 100-8310 (JP); Minoru Hikita, c/o Mitsubishi Denki Kabushiki Kaisha 2-3, Marunouchi 2-chome, Chiyoda-ku, Tokyo 100-8310 (JP)

( * ) Notice: Subject to any disclaimer, the term of this patent is extended or adjusted under 35 U.S.C. 154(b) by 0 days.

(21) Appl. No.: 09/866,629

(22) Filed: May 30, 2001

(65) Prior Publication Data

US 2002/0069844 A1 Jun. 13, 2002

(30) Foreign Application Priority Data

Dec. 13, 2000 (JP) ..... 12-379189

(51) Int. Cl.[7] ..... F01L 1/34
(52) U.S. Cl. ..... 123/90.17; 123/90.37
(58) Field of Search ..... 123/90.15, 90.17, 123/90.31, 90.37; 74/568 R; 464/1, 2, 160

(56) References Cited

U.S. PATENT DOCUMENTS 5,865,150 A * 2/1999 Kramer et al. ..... 123/90.17
5,957,098 A * 9/1999 Fukuhara et al. ..... 123/90.17
6,032,626 A * 3/2000 Haag ..... 123/90.17
6,017,447 A1 * 1/2001 Kohrs et al. ..... 123/90.17
6,173,688 B1 * 1/2001 Fukuhara et al. ..... 123/90.17

FOREIGN PATENT DOCUMENTS

| | | |
|---|---|---|
| JP | 10-331613 | 12/1998 |
| JP | 11-30111 | 2/1999 |
| JP | 2000-265815 | 9/2000 |

* cited by examiner

*Primary Examiner*—Weilun Lo

(57) ABSTRACT

A seal member of a seal unit of a valve timing adjusting device has foot portions and protrusive guides protruding from a seal reverse plane along internal surfaces of the foot portions. A plate spring of the seal unit has foot portions and fork portions arranged on top ends of the foot portions. A slit is formed in each fork portion to allow the insertion of the protrusive guide when the plate spring is fitted to the seal member. The positional relationship between the slit and the protrusive guide is determined on condition that the plate spring fitted to the seal member does not detach from the seal member and the plate spring does not collide with the protrusive guide when the plate spring is bent to arrange the seal unit in the valve timing adjusting device. When the plate spring is fitted to the seal member, the slits of the fork portions are positioned just above the protrusive guides, and the plate spring is dropped according to the gravitational force. Thereafter, stopper portions are formed by deforming top end portions of the protrusive guides according to ultrasonic wave machining method, and the plate spring is prevented from detaching from the seal member.

5 Claims, 8 Drawing Sheets

VALVE TIMING ADJUSTING DEVICE HAVING SEAL UNIT

BACKGROUND OF THE INVENTION

1. Field of the Invention

The present invention relates to a valve timing adjusting device in which the open-close timing of a suction valve and/or an exhaust valve of an internal-combustion engine (hereinafter, called an engine) is changed according to operation conditions of the engine.

2. Description of Related Art

Various valve timing adjusting devices have been proposed. In these devices, an open-close timing of a suction valve and/or an open-close timing of an exhaust valve in an engine are adjusted.

FIG. 7 is a horizontal sectional view of an internal structure of a vane type valve timing adjusting device having a plurality of conventional sealing units, and FIG. 8 is a vertical sectional view taken along line A—A of FIG. 7. In FIG. 7 and FIG. 8, referential numeral 1 indicates a housing. The housing 1 is connected with a crank shaft (not shown) denoting an output shaft of an engine through a chain (not shown). In the housing 1, a sprocket 2 rotated with the crank shaft, a casing 3 having a plurality of shoes 3*a* and a cover 4 formed in an annulus ring shape are integrally formed with each other by using a plurality of fixing members 5 such as bolts. The shoes 3*a* protrude from an internal circumferential surface of the casing 3 so as to form a plurality of hydraulic oil chambers. A front side portion of the casing 3 is covered with the cover 4. Also, a rotor 6 is arranged in the housing 1 to allow rotational motion relative to the casing 3. The rotor 6 is fixed to a camshaft 7 by a fixing member 8 such as a bolt. Therefore, the rotational motion of the camshaft 7 relative to the output shaft of the engine is allowed. The camshaft 7 relates to an open-close operation of a suction valve or an exhaust valve. The rotor 6 has a plurality of vanes 6*a*. Each vane 6*a* partitions the corresponding hydraulic oil chamber surrounded by the corresponding shoes 3*a* of the casing 3 into a hydraulic oil chamber 9 for timing advance and a hydraulic oil chamber 10 for timing retard. Also, a plurality of first oil passages 11 and a plurality of second oil passages 12 are arranged in the camshaft 7. Oil is supplied or discharged to/from each hydraulic oil chamber 9 for timing advance through the corresponding first oil passage 11, and oil is supplied or discharged to/from each hydraulic oil chamber 10 for timing retard through the corresponding second oil passage 12.

Also, to prevent oil leakage occurred between each hydraulic oil chamber 9 for timing advance and one hydraulic oil chamber 10 for timing retard adjacent to the hydraulic oil chamber 9 for timing advance, an axial directional slit 13 extending in an axial direction of the rotor 6 is formed in a top portion of the each shoe 3*a* of the casing 3, an axial directional slit 14 extending in an axial direction of the rotor 6 is formed in a top portion of the each vane 6*a* of the rotor 6, and a conventional sealing unit 101 is arranged in each axial directional slit 13 and axial directional slit 14.

Each conventional sealing unit 101 is composed of a sealing member 102 formed of resin and a metallic plate spring 103. Each sealing member 102 slides on an outer circumferential surface of the rotor 6 or an inner circumferential surface of the casing 3, each metallic plate spring 103 pushes the corresponding sealing member 102 toward the outer circumferential surface of the rotor 6 or the inner circumferential surface of the casing 3.

FIG. 9A is a diagonal view showing a structure of the conventional sealing unit 101 not yet arranged in the valve timing adjusting device, and FIG. 9B is a diagonal view showing a structure of the conventional sealing unit 101 which has been already arranged in the valve timing adjusting device. As shown in FIG. 9A and FIG. 9B, the sealing member 102 of each conventional sealing unit 101 has a seal reverse plane 102*a* parallel to a seal plane (not shown) and a pair of foot portions 102*b* protruding from both end portions of the seal reverse plane 102*a*, and the sealing member 102 is formed in a U-shaped section. The plate spring 103 of each conventional sealing unit 101 is composed of a central portion 103*a* formed in an arc shape and a pair of foot portions 103*b* placed on both ends of the central portion 103*a*. In this case, no connecting member is arranged to connect the sealing member 102 with the plate spring 103. Therefore, in cases where the conventional sealing unit 101 is not arranged in the valve timing adjusting device, as shown in FIG. 9A, the sealing member 102 and the plate spring 103 are separated from each other. When the conventional sealing unit 101 is arranged in the valve timing adjusting device, as shown in FIG. 9B, the foot portions 103*b* of the plate spring 103 are put on the seal reverse plane 102*a* of the sealing member 102, the valve timing adjusting device is laid down, and the sealing member 102 and the plate spring 103 are pushed into each axial directional slit 13 and axial directional slit 14 from the top while sliding on the surface of the slit. In this case, the height of the conventional sealing unit 101 is larger than a width of each axial directional slit 13 and axial directional slit 14 in a radial direction of the rotor 6. Therefore, the central portion 103*a* of the plate spring 103 is pressed hard by the wall of each axial directional slit 13 and axial directional slit 14, and the sealing member 102 and the plate spring 103 are substantially fixed to each other as a unit. Therefore, the sealing member 102 is pushed onto the outer circumferential surface of the rotor 6 or the inner circumferential surface of the casing 3 by the resilient force of the plate spring 103, and the oil leakage between each hydraulic oil chamber 10 for timing retard and the corresponding hydraulic oil chamber 9 for timing advance can be prevented.

However, because the conventional sealing unit 101 of the valve timing adjusting device has the above-described structure, it is required to lay the plate spring 103 having a small size on top of the sealing member 102 and to insert the sealing member 102 and the plate spring 103 into each axial directional slit 13 and axial directional slit 14 of the valve timing adjusting device while setting the sealing member 102 and the plate spring 103 in a standing state. Assuming that the sealing member 102 and the plate spring 103 are inserted into each slit of the valve timing adjusting device by hand, it is possible to arrange the sealing member 102 and the plate spring 103 in the valve timing adjusting device. In contrast, in cases where it is desired to arrange the sealing member 102 and the plate spring 103 in the valve timing adjusting device by using an automatic system, it is required to hold each axial directional slit 13 and axial directional slit 14 by using a chuck. In this case, because an opening of each axial directional slit 13 and axial directional slit 14 is narrow, it is difficult to obtain a chuck holding space from each axial directional slit 13 and axial directional slit 14. Therefore, it is difficult to reliably arrange the sealing member 102 and the plate spring 103 in the valve timing adjusting device. Also, in cases where the sealing member 102 and the plate spring 103 are fixed to each other by spot welding or screwing to make easy the arranging operation of the seal unit 101, an elastic coefficient of the plate spring 103 is increased when the plate spring 103 is inserted into the axial directional slit 13 or 14, and there is a problem that an excessive load is applied on the plate spring 103.

Also, the conventional sealing unit 101 is frequently used in the valve timing adjusting device. Therefore, in cases where it takes a lot of time to arrange the sealing units 101 in the axial directional slits 13 and 14 respectively, a manufacturing time required to manufacture the valve timing adjusting device is lengthened. Therefore, the arranging operation of the conventional sealing unit 101 is most important to perform the automatic manufacturing of the valve timing adjusting device.

Also, another sealing unit is disclosed in Published Unexamined Japanese Patent Application H11-30111 (1999). In this arranging method of the sealing unit, both end portions of a plate spring are respectively fitted to both ends of a sealing member formed in a U-shaped section, and the sealing unit is tightly inserted into a slit from the bottom side. In this sealing unit, the sealing member and the plate spring are connected with each other before the sealing unit is arranged in a valve timing adjusting device, and the arranging operation is easily performed. However, because the movement of the plate spring in a width direction of the sealing member is allowed, there is a high possibility that the plate spring is moved in the width direction of the sealing member and detaches from the sealing member.

Also, another sealing unit is disclosed in Published Unexamined Japanese Patent Application H10-331613 (1998). In this arranging method of the sealing unit, a plate spring formed in a wave shape is arranged in a sealing member formed in a C-shaped section, and the plate spring is exposed from a hole which is formed on a bottom surface of the sealing member. In this sealing unit, because the movement of the plate spring in any direction is prohibited, there is no possibility that the plate spring detaches from the sealing member. However, the plate spring is substantially fixed to the sealing member. Therefore, the elastic coefficient of the plate spring is increased in the same manner as in the above description, and there is a problem that an excessive load is applied on the plate spring.

SUMMARY OF THE INVENTION

An object of the present invention is to provide, with due consideration to the drawbacks of the valve timing adjusting device, a valve timing adjusting device in which a plate spring is reliably prevented from detaching from a sealing member without giving a large load to the plate spring.

The object is achieved by the provision of a valve timing adjusting device comprising an output shaft of an internal-combustion engine, a casing which is fixed to the output shaft and has a plurality of shoes protruding from an internal circumferential surface to form a plurality of hydraulic oil chambers, a rotor which is arranged in the casing so as to be fixed to a camshaft and has a plurality of vanes to partition each hydraulic oil chamber of the casing into a hydraulic oil chamber for timing advance and a hydraulic oil chamber for timing retard, and a sealing unit, which is arranged between the rotor and the casing, for preventing oil leakage between one hydraulic oil chamber for timing advance and one hydraulic oil chamber for timing retard adjacent to the hydraulic oil chamber for timing advance. Rotational motion of the rotor relative to the casing is allowed to change a rotational phase of the camshaft relative to the output shaft. The sealing unit comprises a sealing member having both a seal plane sliding on an inner wall surface of the hydraulic oil chamber for timing advance or the hydraulic oil chamber for timing retard and a seal reverse plane parallel to the seal plane, a plate spring for pushing the seal reverse plane of the sealing member toward the inner wall surface of the hydraulic oil chamber for timing advance or the hydraulic oil chamber for timing retard, and plate spring detachment preventing means. The plate spring detachment preventing means comprises a protruding member, which protrudes from the seal reverse plane of the sealing member, for restricting the movement of the plate spring along the seal reverse plane of the sealing member within a prescribed range, and a detachment stopping member, which is arranged on the top of the protruding member, for restricting the movement of the plate spring away from the seal reverse plane of the sealing member within another prescribed range.

In the above configuration, the movement of the plate spring along the seal reverse plane of the sealing member is restricted within a prescribed range by the protruding member. Also, the movement of the plate spring away from the seal reverse plane of the sealing member is restricted within another prescribed range by the detachment stopping member. Therefore, the plate spring does not detach from the seal member after the fitting of the plate spring to the seal member. Also, when the seal unit is arranged in the valve timing adjusting device while bending the plate spring, the plate spring does not collide with the seal member.

Accordingly, no excessive load is applied on the plate spring, and the plate spring can be reliably prevented from detaching from the seal member when the seal unit is arranged in the valve timing adjusting device.

It is preferred that the detachment stopping member of the plate spring detachment preventing means is obtained by deforming a top portion of the protruding member according to ultrasonic wave machining method.

Accordingly, time required to fit the plate spring to the seal member can be shortened as compared with another fitting method. Also, a degree of a length change of the plate spring is stable. Therefore, the manufacturing time of the valve timing adjusting device assembled by using an automatic assembly line can be shortened, and the quality of the valve timing adjusting device can be stabilized.

It is preferred that the sealing member has a pair of foot portions protruding from both ends of the seal reverse plane respectively and is formed in a U-shaped section, and the protruding member of the plate spring detachment preventing means is formed of a pair of protruding portions which respectively protrude from the seal reverse plane along the foot portions.

Accordingly, the movement of the plate spring along the seal reverse plane of the sealing member is restricted within a prescribed range by the pair of protruding portions.

It is preferred that the sealing member is formed in a box shape and has a wall protruding from an end of the seal reverse plane, and the protruding member of the plate spring detachment preventing means protrudes from the seal reverse plane along an inner surface of the wall of the sealing member.

Accordingly, the movement of the plate spring along the seal reverse plane of the sealing member is restricted within a prescribed range by the protruding member.

It is preferred that the plate spring has a cut-out opening to position the plate spring by using a chuck of an automatic system to fit the plate spring to the sealing member.

Accordingly, the plate spring can be held by the chuck on the automatic assembly line until the plate spring is brought down on the seal reverse surface.

DETAILED DESCRIPTION OF THE PREFERRED EMBODIMENTS

Embodiments of the present invention will now be described with reference to the accompanying drawings.

EMBODIMENT 1

Figure 1A:
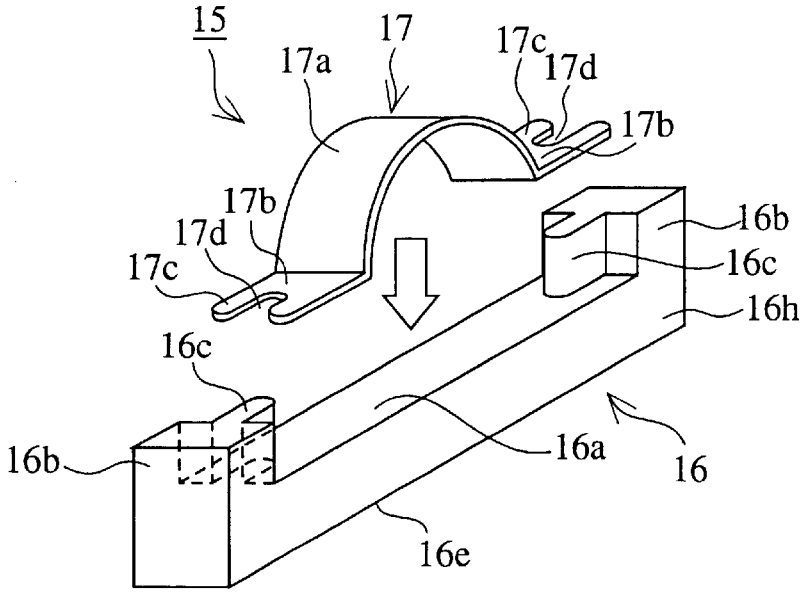
FIG. 1A to FIG. 1C are respectively diagonal views of a sealing unit and showing a plurality of steps of fitting a plate spring to a sealing member in the manufacturing of a valve timing adjusting device according to a first embodiment of the present invention.
Figure 1B:
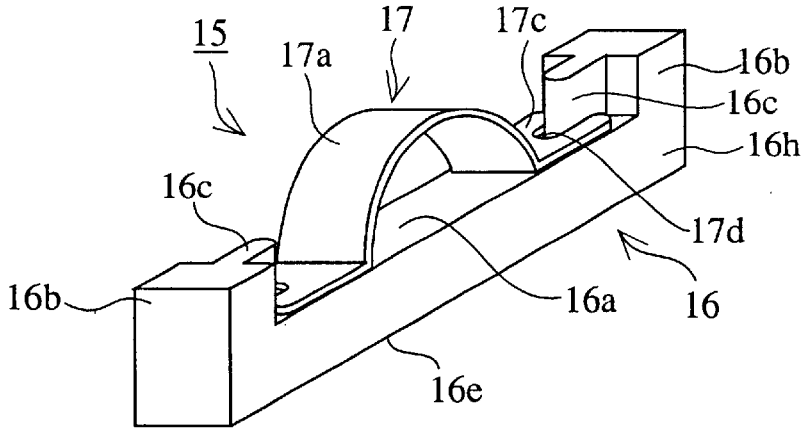
Figure 1C:
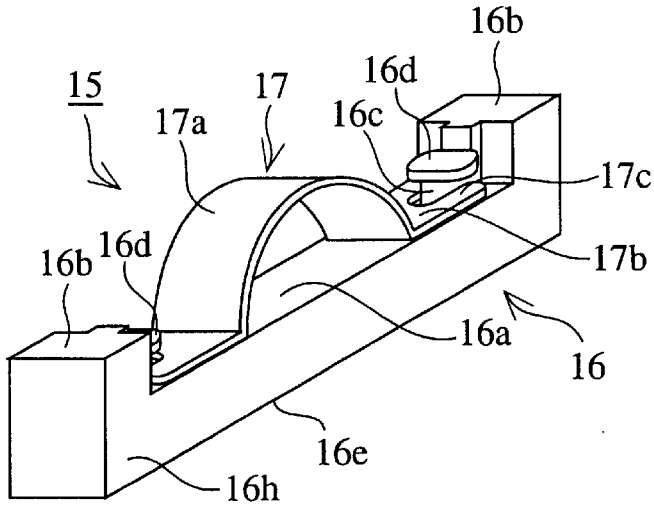
Figure 2A:
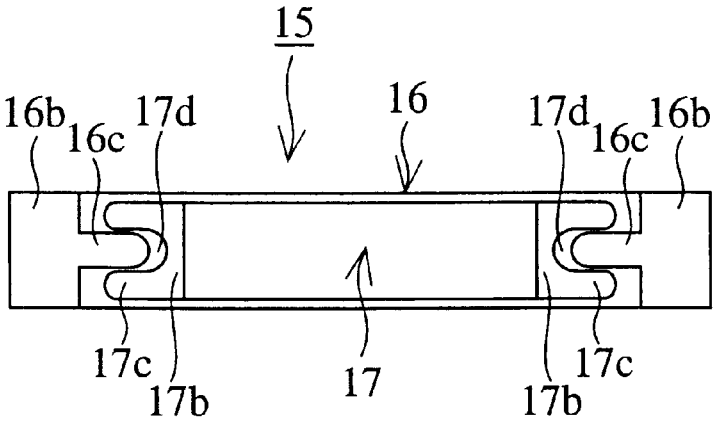
FIG. 2A is a plan view of the sealing unit shown in FIG. 1B.
Figure 2B:
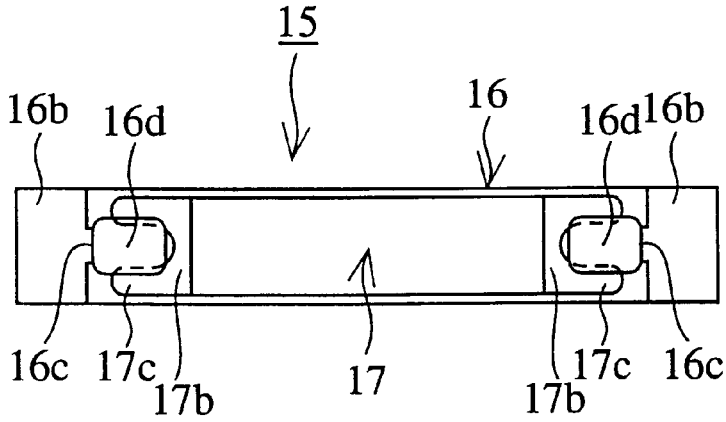
FIG. 2B is a plan view of the sealing unit shown in FIG. 1C.

FIG. 1A to FIG. 1C are respectively diagonal views of a sealing unit and showing a plurality of steps of fitting a plate spring to a sealing member in the manufacturing of a valve timing adjusting device according to a first embodiment of the present invention. FIG. 2A is a plan view of the sealing unit shown in FIG. 1B, and FIG. 2B is a plan view of the sealing unit shown in FIG. 1C. Here, constitutional elements, which are the same or equivalent to those shown in FIG. 7, FIG. 8, FIG. 9A or FIG. 9B, are indicated by the same referential numerals shown in FIG. 7, FIG. 8, FIG. 9A or FIG. 9B, and additional description of those constitutional elements is omitted.

Figure 7:
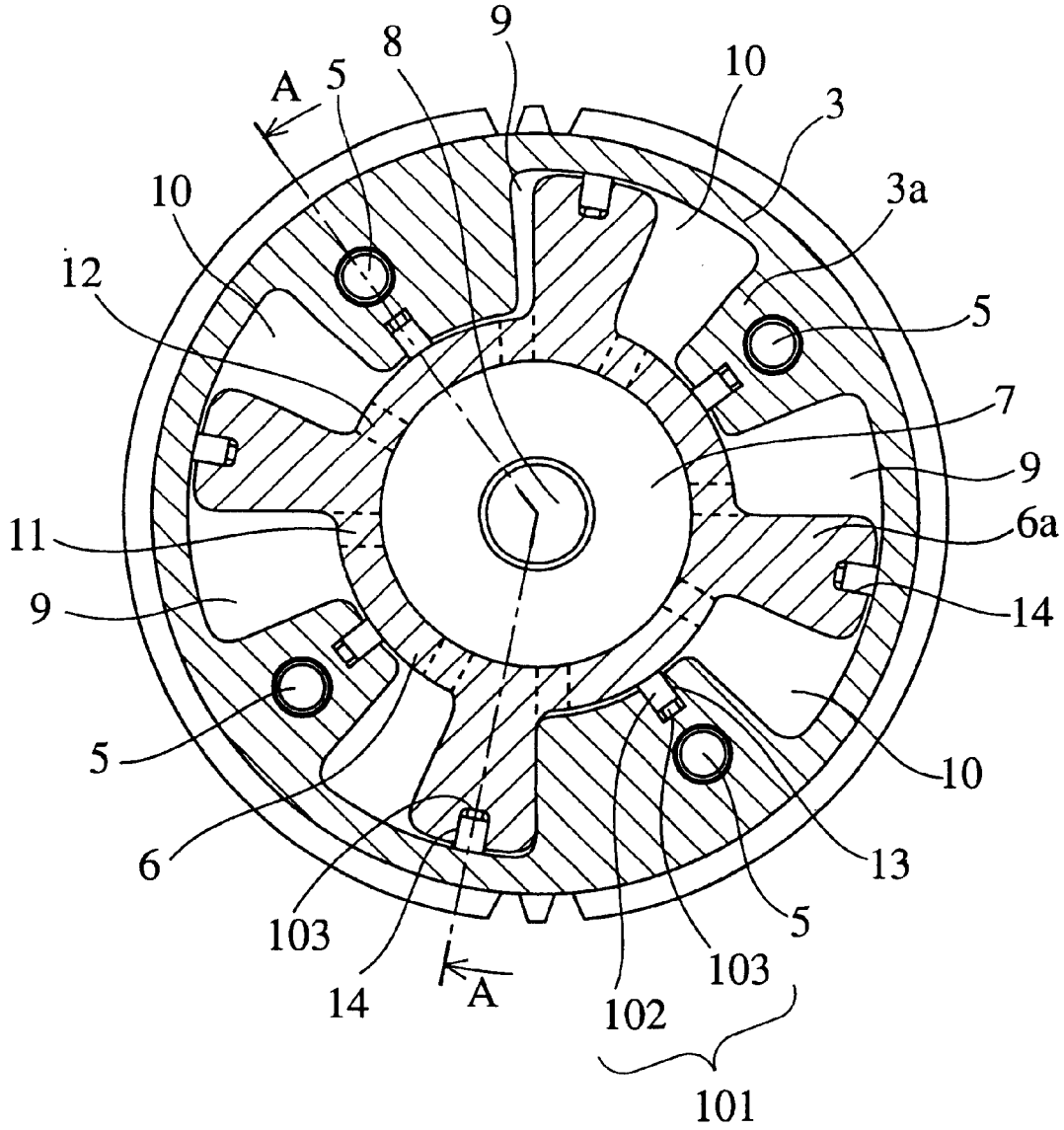
FIG.7 (PRIOR ART)
FIG. 7 is a horizontal sectional view of an internal structure of a vane type valve timing adjusting device having a plurality of conventional sealing units.
Figure 8:
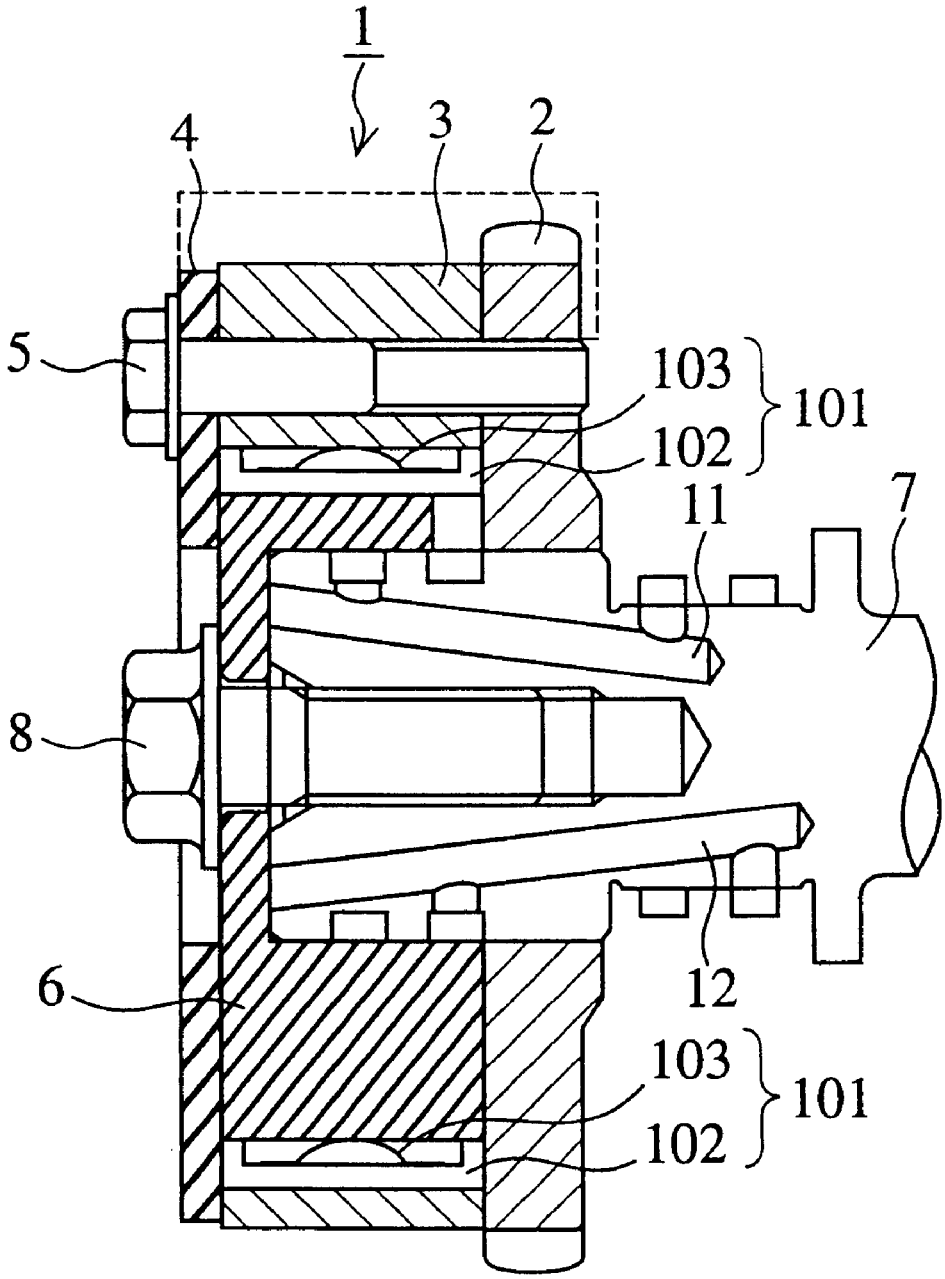
FIG.8 (PRIOR ART)
FIG. 8 is a vertical sectional view taken along line A—A of FIG. 7.
Figure 9A:
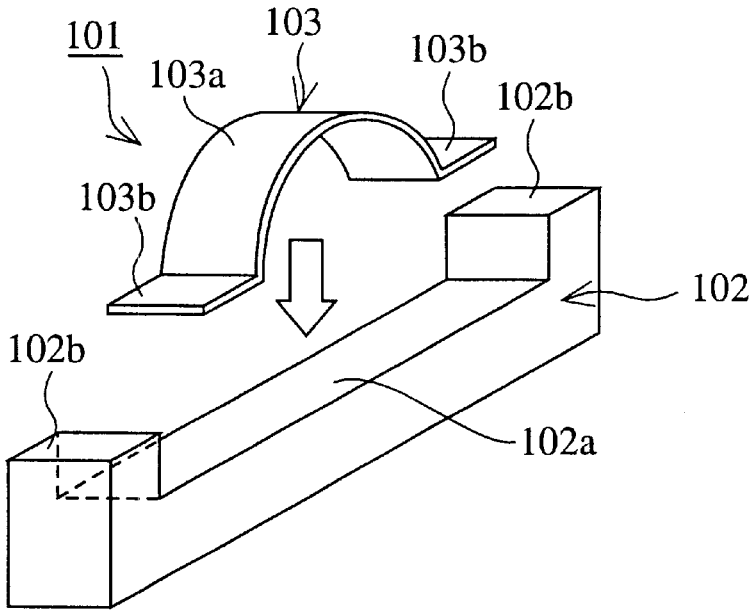
FIG.9A (PRIOR ART)
FIG. 9A is a diagonal view showing a structure of a conventional sealing unit not yet arranged in the valve timing adjusting device.
Figure 9B:
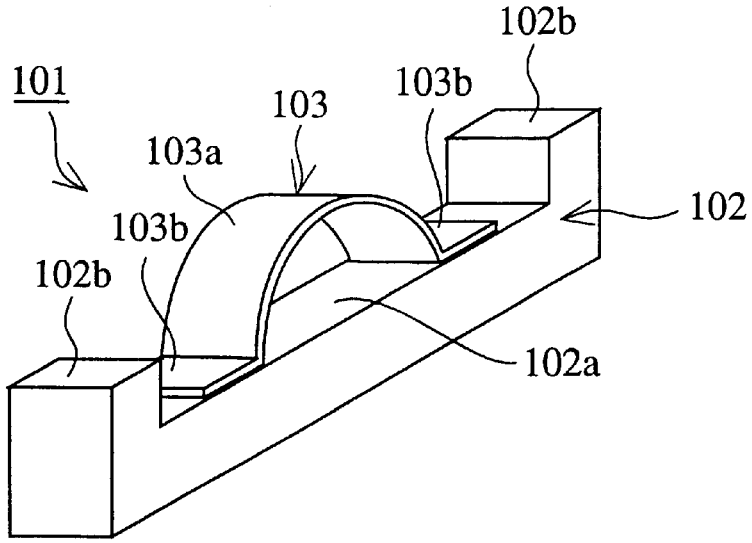
FIG.9B (PRIOR ART)
FIG. 9B is a diagonal view showing a structure of the conventional sealing unit which has been already arranged in the valve timing adjusting device.

A sealing unit 15 is arranged in each axial directional slit 13 and axial directional slit 14 shown in FIG. 7 to prevent oil leakage occurred between each hydraulic oil chamber 9 for timing advance and one hydraulic oil chamber 10 for timing retard adjacent to the hydraulic oil chamber 9 for timing advance, each sealing unit 15 comprises a sealing member 16 formed of resin and a plate spring 17 formed of metal. Each sealing member 16 slides on an outer circumferential surface of the rotor 6 or an inner circumferential surface of the casing 3. When the sealing unit 15 is arranged in the valve timing adjusting device shown in FIG. 7 and FIG. 8, each plate spring 17 pushes the corresponding sealing member 16 onto the outer circumferential surface of the rotor 6 or the inner circumferential surface of the casing 3.

The sealing member 16 has a seal plane 16*e* and a seal reverse plane 16*a* opposite to the seal plane 16*e*. The seal reverse plane 16*a* is formed in parallel to the seal plane 16*e*. The sealing member 16 comprises a body portion 16*h*, a pair of foot portions 16*b* and two protrusive guides (protrusive member, protrusive portions) 16*c*. The pair of foot portions 16*b* protrude from both ends of the seal reverse plane 16*a* so as to place the seal reverse plane 16*a* between the foot portions 16*b*. Each protrusive guide 16*c* protrudes from the seal reverse plane 16*a* along an inner surface of the corresponding foot portion 16*b*. Therefore, the protrusive guides 16*c* face each other. The sealing member 16 slides on an inner wall surface of the hydraulic oil chamber 9 for timing advance or the hydraulic oil chamber 10 for timing retard when the sealing unit 15 is tightly inserted into each axial directional slit 13 and axial directional slit 14 of the casing 3 and the rotor 6, and the seal plane 16*e* of the sealing member 16 makes contact with an inner surface of the hydraulic oil chamber 9 for timing advance or the hydraulic oil chamber 10 for timing retard.

The plate spring 17 of the sealing unit 15 comprises a central portion 17*a* formed in an arc shape, two foot portions 17*b* which are arranged in parallel to each other on both ends of the central portion 17*a* respectively, and two fork portions 17*c* arranged on top ends of the foot portions 17*b*. Each fork portion 17*c* has a slit 17*d*. When the plate spring 17 is fitted to the sealing member 16, each protrusive guide 16C is loosely inserted into the slit 17*d* of the corresponding fork portion 17*c*.

Next, a size relationship among the protrusive guide 16C of the sealing member 16, the fork portion 17*c* of the plate spring 17 and the slit 17*d* of the plate spring 17 is described below.

In cases where the sealing unit 15 having the plate spring 17 fitted to the sealing member 16 is arranged in each axial directional slit 13 and axial directional slit 14 of the valve timing adjusting device shown in FIG. 7, the central portion 17*a* of the plate spring 17 deforms under pressure. In this case, a degree of a length change (or a stroke) of the central portion 17*a* in the longitudinal direction of the sealing member 16 due to the bending of the central portion 17*a* is expressed by a value ST1. The degree ST1 of the length change is, for example, 0.5 mm. In this embodiment, a clearance between the innermost point of each slit 17*d* of the plate spring 17 and the top end of the corresponding protrusive guide 16*c* is set to a value higher than the value ST1. Therefore, a following effect is obtained. That is, when the sealing unit 15 is arranged in the valve timing adjusting device, the central portion 17*a* of the plate spring 17 deforms under pressure, and the top end of each foot portion 17*b* moves away from the center of the sealing member 16. In this case, assuming that the foot portion 17*b* of the plate spring 17 collides with the corresponding protrusive guide 16*c* of the sealing member 16, an excessive load is applied on the plate spring 17. However, because the clearance is set to a value higher than the value ST1, each foot portion 17*b* of the plate spring 17 is prevented from colliding with the corresponding protrusive guide 16*c* of the sealing member 16. Therefore, the plate spring 17 can be prevented from receiving the excessive load.

Also, the fork portion 17*c* of the plate spring 17 overlaps with the corresponding protrusive guide 16*c* of the sealing member 16 in the longitudinal direction of the sealing member 16. The length of this overlapping section is set to be longer than the clearance between the innermost point of each slit 17*d* of the plate spring 17 and the top end of the corresponding protrusive guide 16*c*. Therefore, even though one foot portion 17*b* of the plate spring 17 moves nearer to the corresponding protrusive guide 16*c* of the sealing member 16, the fork portion 17*c* of the plate spring 17 inserted into the other protrusive guide 16*c* of the sealing member 16 is prevented from detaching from the protrusive guide 16*c*.

In other words, it is important to prevent the plate spring 17 from detaching from the sealing member 16 and to avoid the hard contact of the plate spring 17 with the sealing member 16. Therefore, in this embodiment, a slit width in each fork portion 17*c* of the plate spring 17 is set to be slightly larger than a width of the corresponding protrusive guide 16*c* of the sealing member 16. Therefore, each foot portion 17*b* of the plate spring 17 can move away from the center of the sealing member 16 without being obstructed by the corresponding protrusive guide 16*c* or making hard contact with the corresponding protrusive guide 16*c*. Also, because a slight difference is set between the slit width and the width of the protrusive guide 16*c*, the plate spring 17 is prevented from detaching from the sealing member 16 in a direction perpendicular to the longitudinal direction of the sealing member 16.

Therefore, the movement of the plate spring 17 along the seal reverse plane 16*a* (in other words, the movement of the plate spring 17 in the longitudinal direction of the sealing member 16 and the movement of the plate spring 17 in a direction perpendicular to the longitudinal direction of the sealing member 16) is restricted within a prescribed range which is determined by a size difference between the fork portion 17*c*, the slit 17*d* and the protrusive guide 16*c*.

Also, as shown in FIG. 1C and FIG. 2B, a stopper portion (detachment stopping member, detachment stopping portion) 16*d* is arranged on the top of each protrusive guide 16*c* of the sealing member 16. The stopper portion 16*d* is, for example, formed by deforming a top portion of the corresponding protrusive guide 16*c* according to a well-known ultrasonic wave machining method. The shape of the stopper portion 16*d* is not limited, but a width size of the stopper portion 16*d* is set so as to be larger than a width of the corresponding slit 17*d* of the plate spring 17. Therefore, the movement of the plate spring 17 away from the seal reverse plane 16*a* along the longitudinal direction of the protrusive guide 16*c* is restricted by the stopper portions 16*d*. In general, it is preferred that the formation of the stopper portions 16*d* according to the ultrasonic wave machining method is performed after the plate spring 17 is put on the seal reverse plane 16*a* of the sealing member 16. Also, it is possible that the plate spring 17 be arranged between the protrusive guides 16*c* by using the resilient force of the plate spring 17 after the formation of the stopper portions 16*d*. However, in cases where the valve timing adjusting device having the sealing units 15 according to the first embodiment is manufactured on an automatic assembly line, the method of fitting the plate spring 17 to the sealing member 16 before the formation of the stopper portions 16*d* is superior in the manufacturing process.

In the first embodiment, a plate spring detachment preventing means comprises the protrusive guides 16*c* and the stopper portions 16*d*. The plate spring detachment preventing means allows the plate spring 17 to move within a prescribed range in any three-dimensional direction, and the plate spring detachment preventing means reliably prevents the plate spring 17 from detaching from the sealing member 16.

Next, a plurality of steps of fitting the plate spring 17 to the sealing member 16 in the manufacturing of the valve timing adjusting device according to the first embodiment are described below with reference to FIG. 1A, FIG. 1B, FIG. 1C, FIG. 2A and FIG. 2B.

The sealing member 16 is horizontally arranged so as to place the seal reverse plane 16*a* on the upper side (refer to FIG. 1A). On the automatic assembly line, a plurality of sealing members 16 are arranged in advance in parallel to each other. Thereafter, each plate spring 17 is moved on an upper position of the corresponding sealing member 16, the slits 17*d* of the fork portions 17*c* of the plate spring 17 are precisely positioned just above the protrusive guides 16*c* of the sealing member 16, and the plate spring 17 is dropped according to the gravitational force. Therefore, the plate spring 17 is guided by the protrusive guides 16*c* and reaches on the seal reverse plane 16*a* of the sealing member 16 (refer to FIG. 1B and FIG. 2A).

Thereafter, an ultrasonic wave swaging horn (not shown) is applied to an upper end portion of each protrusive guide 16*c* of the sealing member 16 to deform the upper end portion of the protrusive guide 16*c* to the stopper portion 16*d* (refer to FIG. 1C and FIG. 2B). Therefore, the movement of the plate spring 17 away from the seal reverse plane 16*a* along each protrusive guide 16*c* is allowed within a prescribed range from the seal reverse plane 16*a* to a bottom surface of the corresponding stopper portion 16*d* by the stopper portion 16*d*. Also, the stopper portions 16*d* prevent the plate spring 17 from detaching from the sealing member 16. In this case, it is preferred that the stopper portions 16*d* of the sealing member 16 are simultaneously formed. Also, it is preferred that the plurality of plate springs 17 are successively arranged on the seal reverse planes 16*a* of the sealing members 16 arranged in parallel to each other on the automatic assembly line and the ultrasonic wave machining method is successively performed for the protrusive guides 16*c* by the pair of horns to form the stopper portions 16*d* of the sealing members 16. Here, the frequency of the ultrasonic wave is, for example, set to 40 kHz, and the deforming time is set to about 0.2 seconds. However, conditions of the ultrasonic wave are not limited.

As is described above, in the first embodiment, the movement of the plate spring 17 along the seal reverse plane 16*a* of the sealing member 16 can be restricted by the protrusive guides 16*c* of the sealing member 16, the movement of the plate spring 17 away from the seal reverse plane 16*a* along the protrusive guides 16*c* can be restricted by the stopper portions 16*d*. Accordingly, the plate spring 17 can be reliably prevented from detaching from the sealing member 16 when the plate spring 17 is fitted to the sealing member 16 to arrange the sealing unit 15 in the valve timing adjusting device. Also, it is not required to apply a force of displacement to the plate spring 17 when the plate spring 17 is fitted to the sealing member 16. Therefore, a change of the load on the plate spring 17 can be eliminated.

Also, in the first embodiment, the movement of the plate spring 17 along the seal reverse plane 16*a* of the sealing member 16 can be allowed within a prescribed range by the protrusive guides 16*c* of the sealing member 16, and the movement of the plate spring 17 away from the seal reverse plane 16*a* along each protrusive guide 16*c* of the sealing member 16 can be allowed within a prescribed range by the stopper portions 16*d* of the sealing member 16. Therefore, even though the plate spring 17 is bent and deformed by a force added to the plate spring 17 when the sealing unit 15 is arranged in the valve timing adjusting device, the movement of the foot portions 17*b* of the plate spring 17 due to the deformation of the plate spring 17 is not obstructed by the protrusive guides 16*c* or the stopper portions 16*d* of the sealing member 16. Accordingly, no excessive load is applied on the plate spring 17.

Also, in the first embodiment, as shown in FIG. 1C and FIG. 2B, the sealing member 16 and the plate spring 17 can be integrally fitted to each other. Therefore, many sealing units 15 in this fitting state can be stocked. Therefore, many sealing units 15 in this fitting state can be preserved in a stockyard other than the automatic assembly line, and a plurality of sealing units 15 required can be supplied for the automatic assembly line. Also, even though the sealing member 16 is set in a standing position, the plate spring 17 is not dropped. Accordingly, many sealing units 15 can be arranged in parallel to each other or be carried by using an oscillation generating machine, and the automatic assembly of the valve timing adjusting device can be easily performed.

Also, in the first embodiment, because the stopper portions 16*d* of the sealing member 16 can be formed according to the ultrasonic wave machining method, the fitting time of the plate spring 17 to the sealing member 16 can be shortened. Accordingly, the manufacturing time of the valve timing adjusting device on the automatic assembly line can be shortened.

Also, in the first embodiment, the movement of the plate spring 17 along the seal reverse plane 16*a* of the sealing member 16 is restricted by the protrusive guides 16*c* of the sealing member 16. Thereafter, the stopper portions 16*d* of the sealing member 16 are formed according to the ultrasonic wave machining method. Therefore, defective sealing units, in which no plate spring is arranged on the sealing member 16, can be removed. Accordingly, a mixed sorting in which defective sealing units contaminate non-defective units 5 is prevented.

EMBODIMENT 2

Figure 3A:
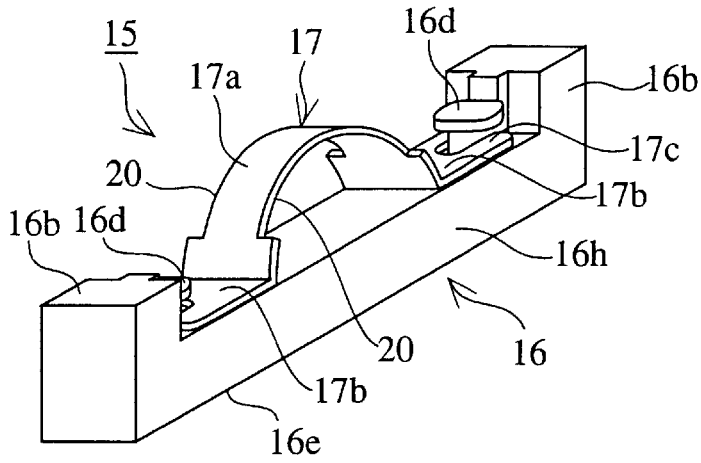
FIG. 3A is a diagonal view showing the structure of a sealing unit in a valve timing adjusting device according to a second embodiment of the present invention.
Figure 3B:
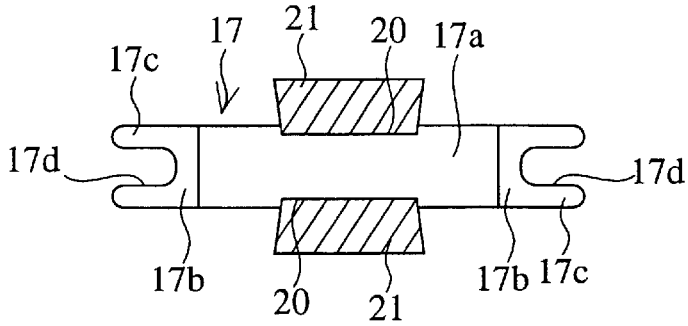
FIG. 3B is a plan view of both a plate spring shown in FIG. 3A and a chuck of an automatic system used to hold the plate spring.
Figure 4:
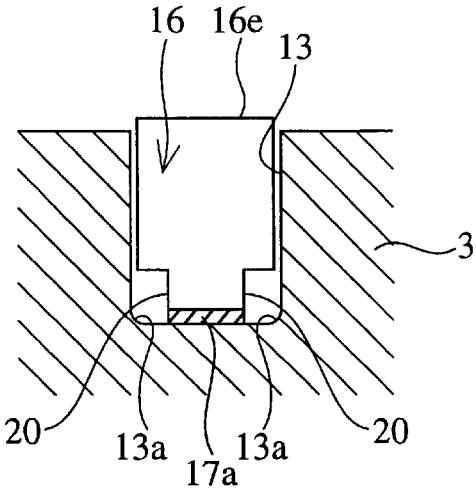
FIG. 4 is a sectional view showing an internal structure of an axial directional slit in which the sealing unit shown in FIG. 3A is inserted.

FIG. 3A is a diagonal view showing the structure of a sealing unit in a valve timing adjusting device according to a second embodiment of the present invention, and FIG. 3B is a plan view of both a plate spring shown in FIG. 3A and a chuck of an automatic system used to hold the plate spring. FIG. 4 is a sectional view showing an internal structure of an axial directional slit in which the sealing unit shown in FIG. 3A is inserted. Here, constitutional elements, which are the same or equivalent to those according to the first embodiment, are indicated by the same referential numerals of the first embodiment, and additional description of those constitutional elements is omitted.

In a second embodiment, a cut-out opening 20 is arranged on both side ends of the central portion 17*a* of the plate spring 17. The cut-out openings 20 are placed in the central portion 17*a* in bilateral symmetry. Each cut-out opening 20 is formed by cutting out the corresponding side end of the central portion 17*a* in a longitudinal direction of the central portion 17*a* by a prescribed length and width. As shown in FIG. 3B, the length of each cut-out opening 20 is the same as that of a chuck 21 of an automatic system (not shown). Therefore, the plate spring 17 is automatically placed just above the sealing member 16 by holding the central portion 17*a* of the plate spring 17 by the chuck 21 while putting the chuck 21 into the cut-out openings 20.

Also, in the first embodiment, the slits 17*d* of the fork portions 17*c* of the plate spring 17 are positioned just above the protrusive guides 16*c* of the sealing member 16, and the plate spring 17 is dropped according to the gravitational force and reaches on the seal reverse plane 16*a* of the sealing member 16 to fit the plate spring 17 to the sealing member 16. However, in this second embodiment, no gravitational force is used. That is, the plate spring 17 held by the chuck 21 is automatically brought down on the seal reverse plane 16*a* of the sealing member 16 on the automatic assembly line, and the chuck 21 is detached from the plate spring 17. Therefore, there is no probability that the protrusive portions 16*d* of the sealing member 16 are not accurately inserted into the slits 17*d* of the fork portions 17*c* of the plate spring 17 when the plate spring 17 is dropped according to the gravitational force.

Also, in the second embodiment, the width of the center portion 17*a* of the plate spring 17 is narrower than that of the sealing member 16 by the cut-out openings 20. Therefore, a following effect can be obtained. That is, the casing 3 and the rotor 6 having the axial directional slits 13 and 14 are often formed of sintered iron. In this case, corner portions in the casing 3 and the rotor 6 are easily formed in a curved shape (or an R shape). Therefore, as shown in FIG. 4, for example, corner portions 13*a* of each axial directional slit 13 of the casing 3 (or each axial directional slit 14 of the rotor 6) are formed in an R shape. In this case, because the width of the center portion 17*a* of the plate spring 17 is narrower than that of the sealing member 16, when the sealing unit 15 is inserted into the axial directional slit 13, the center portion 17*a* of the plate spring 17 is placed on the center of a bottom surface of the axial directional slit 13, and the center portion 17*a* of the plate spring 17 does not make contact with the corner portions 13*a* of the axial directional slit 13. Accordingly, the seal plane 16*e* of the sealing member 16 receiving a pushing force from the plate spring 17 can be precisely positioned in the radial direction of the casing 3 (or the rotor 6), and the whole seal plane 16*e* of the sealing member 16 can reliably make contact with the inner surface of the casing 3 (or the outer surface of the rotor 6). Therefore, a seal performance of the sealing unit 15 can be improved.

EMBODIMENT 3

Figure 5A:
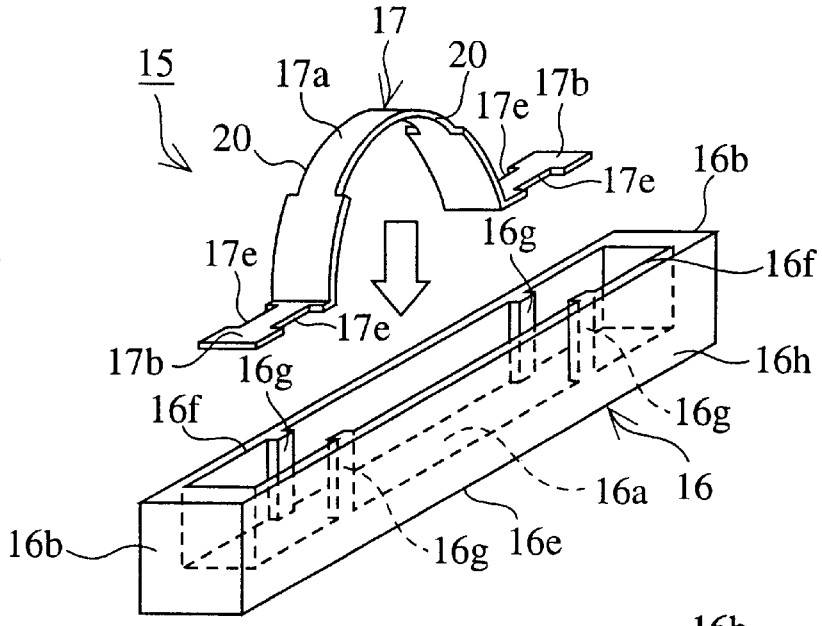
FIG. 5A, FIG. 5B and FIG. 5C are respectively diagonal views of a sealing unit and showing a plurality of steps of fitting a plate spring to a sealing member in the manufacturing of a valve timing adjusting device according to a third embodiment of the present invention.
Figure 5B:
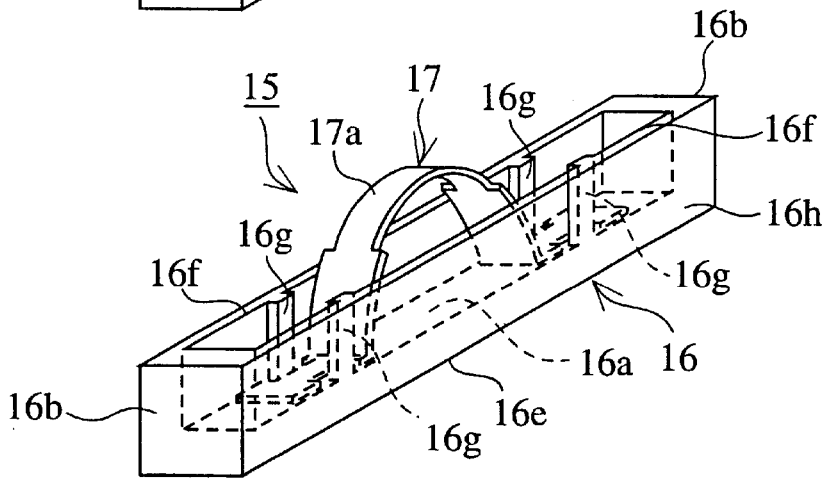
Figure 5C:
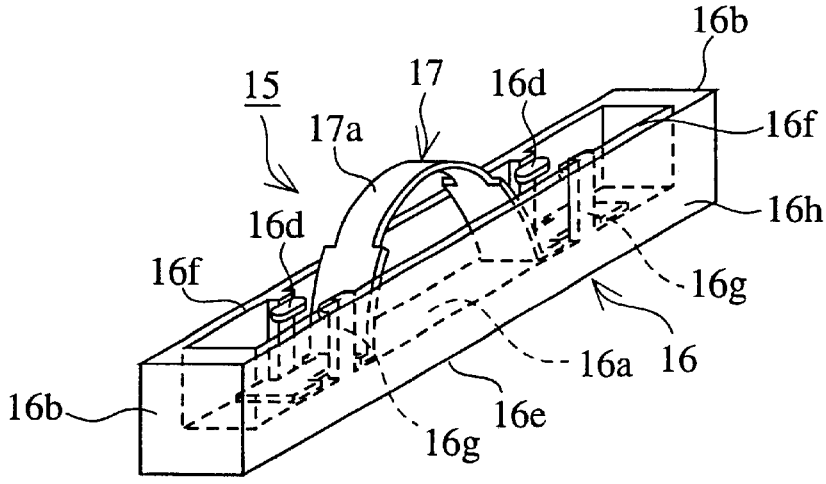
Figure 6A:
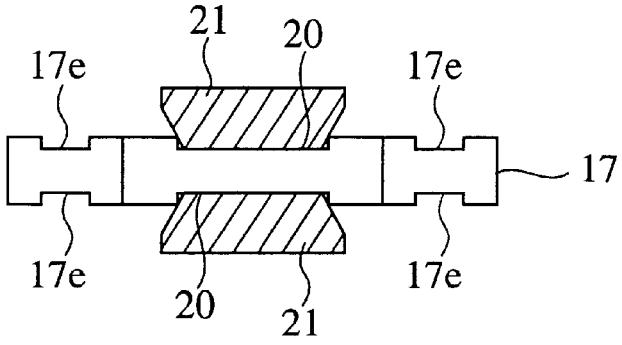
FIG. 6A is a plan view of both the plate spring shown in FIG. 5A and a chuck of an automatic system used to hold the plate spring.
Figure 6B:
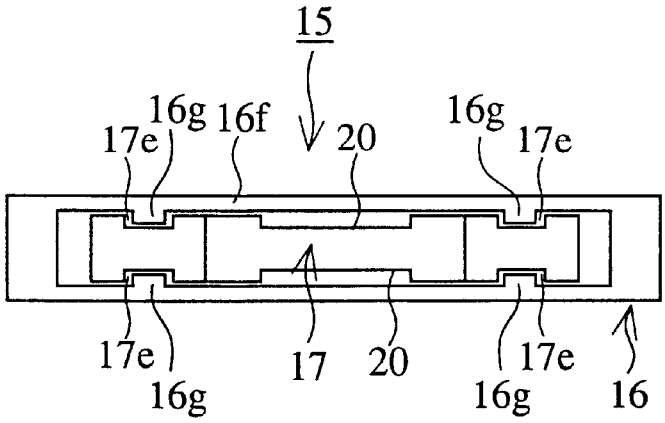
FIG. 6B is a plan view of the sealing unit shown in FIG. 5B.
Figure 6C:
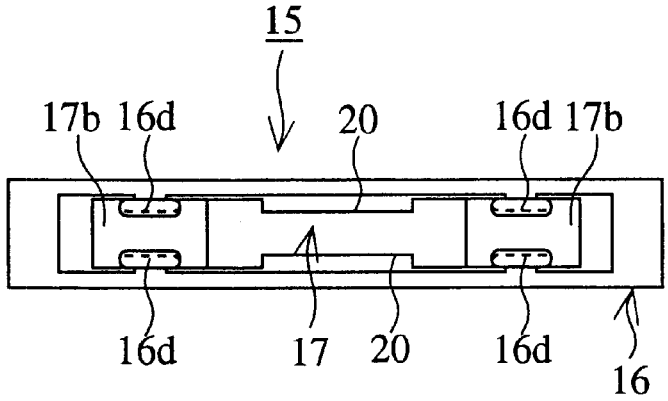
FIG. 6C is a plan view of the sealing unit shown in FIG. 5C.

FIG. 5A, FIG. 5B and FIG. 5C are respectively diagonal views of a sealing unit and showing a plurality of steps of fitting a plate spring to a sealing member in the manufacturing of a valve timing adjusting device according to a third embodiment of the present invention. FIG. 6A is a plan view of both the plate spring shown in FIG. 5A and a chuck of an automatic system used to hold the plate spring, FIG. 6B is a plan view of the sealing unit shown in FIG. 5B, and FIG. 6C is a plan view of the sealing unit shown in FIG. 5C. Here, constitutional elements, which are the same or equivalent to those of the first and second embodiments, are indicated by the same referential numerals of the first and second embodiments, and additional description of those constitutional elements is omitted.

In a third embodiment, the sealing member 16 is formed in a box shape and has a plate spring fitting space in the box. That is, a bottom surface of the box corresponds to the seal reverse plane 16*a*, two wall portions 16*f* protrude from both sides of the seal reverse plane 16*a*, other two wall portions protruding from other two sides of the seal reverse plane 16*a* correspond to the foot portions 16*b*. Therefore, the plate spring fitting space is surrounded by the seal reverse plane 16*a*, the foot portions 16*b* and the wall portions 16*f*. The height of the wall portions 16*f* is the same as that of the foot portions 16*b*. In this case, the height of the wall portions 16*f* is set not to make the chuck 21 of the automatic system collide with upper ends of the wall portions 16*f* when the plate spring 17 held by the chuck 21 at the cut-off openings 20 of the central portion 17*a* is brought down on the seal reverse plane 16*a* of the sealing member 16. Therefore, the sealing member 16 is not displaced or inclined by the collision of the sealing member 16 with the chuck 21, and the setting of the plate spring 17 into the plate spring fitting space of the sealing member 16 can be reliably performed.

Also, a pair of protrusive guides 16*g* protrude from the seal reverse plane 16*a* along the inside surface of each wall portion 16*f* at positions near to the foot portions 16*b*. Each protrusive guide 16*g* placed on the inside surface of one wall portion 16*f* faces one protrusive guide 16*g* placed on the inside surface of the other wall portion 16*f* through the plate spring fitting space. After the plate spring 17 is fitted to the sealing member 16, a stopper portion 16*d* is formed on the top of each protrusive guide 16*g* according to the ultrasonic wave machining method.

Also, in the plate spring 17, a pair of cut-out openings 17*e* are respectively formed on both sides of each foot portion 17*b* of the plate spring 17. When the plate spring 17 is fitted to the sealing member 16, each protrusive guide 16*g* is inserted into the corresponding cut-out opening 17*e*. The length of the cut-out openings 17*e* and the length of the protrusive guides 16*g* in the longitudinal direction of the sealing member 16 are determined according to a degree of a length change (or a stroke) of the central portion 17*a* of the plate spring 17 due to the bending of the central portion 17*a* in the same manner as in the first embodiment. That is, the lengths of the cut-out openings 17*e* and the protrusive guides 16*g* are determined on condition that the foot portions 17*b* of the plate spring 17 do not make contact with the protrusive guides 16*g* or the foot portions 16*b* of the sealing member 16 and the plate spring 17 cannot detach from the sealing member 16.

Next, a plurality of steps of fitting the plate spring 17 to the sealing member 16 according to the third embodiment is described below with reference to FIG. 5A, FIG. 5B, FIG. 5C, FIG. 6A, FIG. 6B and FIG. 6C.

The sealing member 16 is horizontally arranged so as to place the seal reverse plane 16*a* on the upper side (refer to FIG. 6A). On the automatic assembly line, the plurality of sealing members 16 are arranged in advance in parallel to each other. Thereafter, each plate spring 17 is held by the chuck 21 of the automatic system and is moved on an upper position of the corresponding sealing member 16, the cut-out openings 17*e* of the foot portions 17*b* of the plate spring 17 are precisely positioned just above the protrusive guides 16*g* of the sealing member 16, the plate spring 17 is brought down while guiding the plate spring 17 with the protrusive guides 16*g*, and the plate spring 17 reaches on the seal reverse plane 16*a* of the sealing member 16 (refer to FIG. 5B, FIG. 6A and FIG. 6B). Thereafter, the chuck 21 is detached from the plate spring 17.

Thereafter, an ultrasonic wave swaging horn (not shown) is applied to an upper end portion of each protrusive guide 16*g* of the sealing member 16 to deform the upper end portion of the protrusive guide 16*g* to the stopper portion 16*d* (refer to FIG. 5C and FIG. 6C). Therefore, the movement of the plate spring 17 away from the seal reverse plane 16*a* along each protrusive guide 16*g* is allowed within a prescribed range from the seal reverse plane 16*a* to a bottom surface of the corresponding stopper portion 16*d* by the stopper portion 16*d*. Also, the stopper portions 16*d* prevent the plate spring 17 from detaching from the sealing member 16.

As is described above, in the third embodiment, the sealing member 16 is formed in the box shape. Therefore, even though an external force is added to the sealing unit 15, which is stocked in a stockyard other than the assembly line, from a width direction of the sealing unit 15, the movement of the plate spring 17 away from the seal reverse plane 16*a* of the sealing member 16 is prevented by the protrusive guides 16*g* and the wall portions 16*f* of the sealing member 16. Accordingly, in addition to the effects obtained in the first and second embodiments, there is an effect that the production of defective sealing units having no plate spring can be prevented.

What is claimed is:

1. A valve timing adjusting device comprising:

a casing which is connected with an output shaft and has a plurality of shoes protruding from an internal circumferential surface to form a plurality of hydraulic oil chambers;

a rotor which is arranged in the casing so as to be fixed to a camshaft and has a plurality of vanes to partition each hydraulic oil chamber of the casing into a hydraulic oil chamber for timing advance and a hydraulic oil chamber for timing retard, rotational motion of the rotor relative to the casing being allowed to change a rotational phase of the camshaft relative to the output shaft; and a sealing unit, which is arranged between the rotor and the casing, for preventing oil leakage between one hydraulic oil chamber for timing advance and one hydraulic oil chamber for timing retard adjacent to the hydraulic oil chamber for timing advance, characterized in that the sealing unit comprises:

a sealing member having both a seal plane sliding on an inner wall surface of the hydraulic oil chamber for timing advance or the hydraulic oil chamber for timing retard and a seal reverse plane parallel to the seal plane;

a plate spring having a central portion formed in an arc shape and foot portions located at each end of the central portion, wherein the plate spring is adapted to the seal reverse plane of the sealing member toward the inner wall surface of the hydraulic oil chamber for timing advance or the hydraulic oil chamber for timing retard; and plate spring detachment preventing means, comprising a protruding member, which protrudes from the seal reverse plane of the sealing member, for restricting the movement of the plate spring along the seal reverse plane of the sealing member within a prescribed range; and a detachment stopping member, which is arranged on the top of the protruding member, for restricting the movement of the plate spring away from the seal reverse plane of the sealing member within another prescribed range, wherein each foot portion of the plate spring includes a portion into which the corresponding protruding member is loosely inserted and wherein the length of the portion in the longitudinal direction of the sealing member is determined on condition that the portion does not make contact with the corresponding protruding member by arrangement of the sealing unit in the valve timing adjusting device.

2. A valve timing adjusting device according to claim 1, wherein the detachment stopping member of the plate spring detachment preventing means is obtained by deforming a top portion of the protruding member according to ultrasonic wave machining method.

3. A valve timing adjusting device according to claim 1, wherein the sealing member has a pair of foot portions protruding from both ends of the seal reverse plane, respectively, and is formed in a U-shaped section, and the protruding member of the plate spring detachment preventing means is formed of a pair of protruding portions which respectively protrude from the seal reverse plane along the foot portions.

4. A valve timing adjusting device according to claim 1, wherein the sealing member is formed in a box shape and has a wall protruding from an end of the seal reverse plane, and the protruding member of the plate spring detachment preventing means protrudes from the seal reverse plane along an inner surface of the wall of the sealing member.

5. A valve timing adjusting device according to claim 1, wherein the plate spring has a cut-out opening to position the plate spring by using a chuck of an automatic system to fit the plate spring to the sealing member.

* * * * *

UNITED STATES PATENT AND TRADEMARK OFFICE

CERTIFICATE OF CORRECTION

PATENT NO. : 6,516,762 B2 
DATED : February 11, 2003
INVENTOR(S) : Hiroyuki Kinugawa and Minoru Hikita It is certified that error appears in the above-identified patent and that said Letters Patent is hereby corrected as shown below:

Title page,
Item [30], should read
-- [30] Foreign Application Priority Data
Dec. 13, 2000 (JP) ……... 92000-379189 --

Signed and Sealed this

Twenty-ninth Day of July, 2003

JAMES E. ROGAN
*Director of the United States Patent and Trademark Office*

UNITED STATES PATENT AND TRADEMARK OFFICE

CERTIFICATE OF CORRECTION

PATENT NO. : 6,516,762 B2 
DATED : February 11, 2003
INVENTOR(S) : Hiroyuki Kinugawa and Minoru Hikita It is certified that error appears in the above-identified patent and that said Letters Patent is hereby corrected as shown below:

Title page,
Item [30], should read
-- [30] Foreign Application Priority Data
Dec. 13, 2000 (JP) ……... 2000-379189 --

This certificate supersedes Certificate of Correction issued July 29, 2003.

Signed and Sealed this

Eighteenth Day of November, 2003

JAMES E. ROGAN
*Director of the United States Patent and Trademark Office*

UNITED STATES PATENT AND TRADEMARK OFFICE

CERTIFICATE OF CORRECTION

PATENT NO. : 6,516,762 B2
APPLICATION NO. : 09/866629
DATED : February 11, 2003
INVENTOR(S) : Hiroyuki Kinugawa and Minoru Hikita It is certified that error appears in the above-identified patent and that said Letters Patent is hereby corrected as shown below:

On the title page item (73) should read:
(73) Assignee: Mitsubishi Denki Kabushiki Kaisha, Tokyo, JAPAN Signed and Sealed this Fifteenth Day of January, 2008

JON W. DUDAS
*Director of the United States Patent and Trademark Office*